United States Patent [19]

Perkins, Jr.

[11] 4,392,607

[45] Jul. 12, 1983

[54] CARTON WITH INTEGRAL CLOSURES

[75] Inventor: David Perkins, Jr., Des Moines, Iowa

[73] Assignee: Corrugated Drum Systems, Inc., Cedar Rapids, Iowa

[21] Appl. No.: 359,869

[22] Filed: Mar. 19, 1982

Related U.S. Application Data

[63] Continuation-in-part of Ser. No. 220,764, Dec. 29, 1980, abandoned.

[51] Int. Cl.[3] ..... B65D 5/10

[52] U.S. Cl. ..... 229/39 R; 229/38; 229/41 C; 229/44 R

[58] Field of Search ..... 229/38, 39 R, 41 C, 229/41 D, 43, 44 R, 27, 41 R

[56] References Cited

U.S. PATENT DOCUMENTS

| | | | |
|---|---|---|---|
| 598,087 | 2/1898 | Harker | 229/39 R |
| 634,647 | 10/1899 | Knobeloch | 229/39 R |
| 1,127,734 | 2/1915 | Compton | 229/39 R |
| 1,925,298 | 9/1933 | Boeye | 229/38 |
| 1,965,215 | 7/1934 | Boeye | 229/39 R |
| 2,053,857 | 9/1936 | Weiss | 229/16 |
| 2,157,302 | 5/1939 | Page | 229/5.5 |
| 2,163,703 | 6/1939 | Ringler | 220/415 |
| 2,565,188 | 8/1951 | Welshenbach | 229/16 |
| 2,718,998 | 9/1955 | Bemiss | 229/35 |
| 2,845,210 | 7/1958 | Fischer | 229/39 R |
| 3,145,903 | 8/1964 | Franklin, Jr. | 229/27 |
| 3,194,480 | 7/1965 | Maindron | 229/39 R X |
| 3,221,974 | 12/1965 | Scholle | 229/39 R |
| 3,226,007 | 12/1965 | Thies et al. | 229/39 R |
| 3,527,399 | 9/1970 | Cayne, Sr. | 229/39 R |
| 3,873,017 | 3/1975 | Blatt | 229/41 C |
| 3,977,594 | 8/1976 | Swan | 229/39 R |
| 4,119,266 | 10/1978 | Dempster | 229/39 R |
| 4,166,567 | 9/1979 | Beach et al. | 229/41 C |
| 4,166,568 | 9/1979 | Swan | 229/41 C |
| 4,291,827 | 9/1981 | Mulroy | 229/39 R |

FOREIGN PATENT DOCUMENTS

| | | | |
|---|---|---|---|
| 945437 | 1/1956 | Fed. Rep. of Germany | 229/39 R |

*Primary Examiner*—William Price
*Assistant Examiner*—Gary E. Elkins
*Attorney, Agent, or Firm*—Merchant, Gould, Smith, Edell, Welter & Schmidt

[57] ABSTRACT

A carton (20) having a body portion (21) and integral self-locking closures (22, 23) at its ends. The closures have outer flaps (43, 44, 87, 90) and inner flaps (39, 40, 83, 84), with slots (63, 70, 103, 104, 106, 107) to engage lock tabs (61, 62, 66, 67, 74, 75, 81, 82, 112, 113, 116, 117), which retain the closures in closed position. An internal liner (122) may be provided, and certain tabs (212, 213, 216, 217) and slots (203, 204, 206, 207) may be made convergent if desired.

4 Claims, 13 Drawing Figures

CARTON WITH INTEGRAL CLOSURES

This application is a continuation in part of Ser. No. 220,764 filed Dec. 29, 1980, now abandoned.

TECHNICAL FIELD

This invention relates to the field of packaging, and more particularly to collapsible containers made of material such as paperboard, which can be supplied flat and erected simply and rapidly at their destination.

BACKGROUND OF THE INVENTION

Many kinds of goods are supplied in containers of paperboard or similar material. The containers are obtained from manufacturers, and of course must be supplied empty. It is desirable that containers be so designed that they can be supplied in bulk by their manufacturers, and stored prior to use, in compact form.

BRIEF DESCRIPTION OF THE INVENTION

This invention comprises a container in which both a bottom closure and a top closure are integral with the body of the container and not separable therefrom. The body is of polygonal cross-section, and each closure comprises lips and inner and outer flaps mutually separate but integral with body panels along fold lines. The outer flaps are provided with tabs, and the inner flaps are provided with slots with which the tabs are engaged as the cartons are closed to prevent reopening of the closure after it is completed. In one embodiment of the invention a bottom liner is provided to increase the security of the bottom closure; in another, certain slots and tabs of the bottom closure are angulated.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing, in which like reference numerals indicate corresponding parts throughout the several views.

DESCRIPTION OF THE PREFERRED EMBODIMENT

Figure 1:
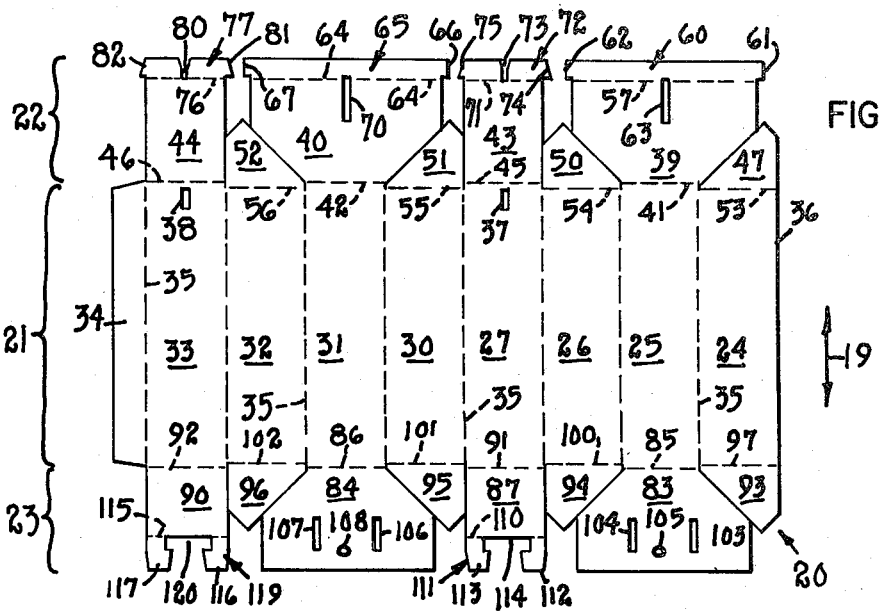
FIG. 1 shows a blank for a carton according to the invention having integral self-locking top and bottom closures.

A blank 20 for a carton according to the invention is shown in FIG. 1 to consist of a body portion 21, a top closure portion 22, and a bottom closure portion 23. The container shown is octagonal in transverse cross-section, and body portion 21 comprises panels 24, 25, 26, 27, 30, 31, 32, and 33, and a sealing flap 34, integral along fold lines 35. If the material for the carton is corrugated, the corrugations should have the direction indicated by the double-headed arrow 19. Flap 34 is to be secured to the edge 36 of the opposite body panel 24 by suitable fastening means such as staples or cement. Body panels 27 and 33 are provided with medial lock slots 37 and 38 respectively extending parallel to body fold lines 35.

Top closure portion 22 is cut to comprise separate inner flaps 39 and 40 integral with body panels 25 and 31 along fold lines 41 and 42, separate outer flaps 43 and 44 integral with body panels 27 and 33 along fold lines 45 and 46, and separate lips 47, 50, 51, and 52 integral with body panels 24, 26, 30, and 32 along fold lines 53, 54, 55, and 56, all respectively. Fold lines 53-56 are colinear, and fold lines 41, 42 and fold lines 45, 46 are independently colinear.

Inner flap 39 is integral along a fold line 57 with a tab strip 60 having outward tabs 61 and 62, and is provided with a center slot 63 extending parallel to body fold lines 35. Inner flap 40 is integral along a fold line 64 with a tab strip 65 having outward tabs 66 and 67, and is provided with a center slot 70 extending parallel to body fold lines 35. Tabs 61 and 67 are for engagement with lock slot 38 of body panel 33, and tabs 62 and 66 are for engagement with lock slot 37 of body panel 27. Tab strips 60 and 65 also provide structural cross-beam support for the top closure.

Outer flap 43 is integral along a fold line 71 with a tab strip 72 having a central slot 73 and a pair of outward tabs 74, 75. Outer flap 44 is integral along a fold line 76 with a tab strip 77 having a central slot 80 and a pair of outward tabs 81 and 82. Fold lines 57, 64, 71, and 76 may be colinear along a line which also defines the outer ends of slots 63 and 70 and the bottoms of slots 73 and 80. Tabs 74 and 82 are for engagement with center slot 63 of inner flap 39; and tabs 75 and 81 are for engagement with center slot 70 of inner flap 40.

Bottom closure 23 is cut to comprise separate inner flaps 83 and 84 integral with body panels 25 and 31 along fold lines 85 and 86, separate outer flaps 87 and 90 integral with body panels 27 and 33 along fold lines 91 and 92, and separate lips 93, 94, 95, and 96 integral with body panels 24, 26, 30 and 32 along fold lines 97, 100, 101, and 102, all respectively. Fold lines 97, 100, 101 and 102 are colinear, and fold lines 85 and 86 and fold lines 91 and 92 are independently colinear.

Inner flap 83 is provided with a pair of laterally spaced slots 103 and 104 extending parallel to body fold lines 35, and with a thumb hole 105. Inner flap 84 is provided with a laterally spaced pair of slots 106, 107 extending parallel to body fold lines 35, and with a thumb hole 108.

Outer flap 87 is integral along a fold line 110 with a tab strip 111 comprising a pair of inward tabs 112 and 113 separated by a recess 114. Outer flap 90 is integral along a fold line 115 with a tab strip 119 having a pair of inward tabs 116, 117 separated by a recess 120. Fold lines 110 and 115 may be colinear. Tabs 112, 113, 116, and 117 are for reception respectively in slots 104, 106, 107, and 103 of inner flaps 83 and 84.

Figure 6:
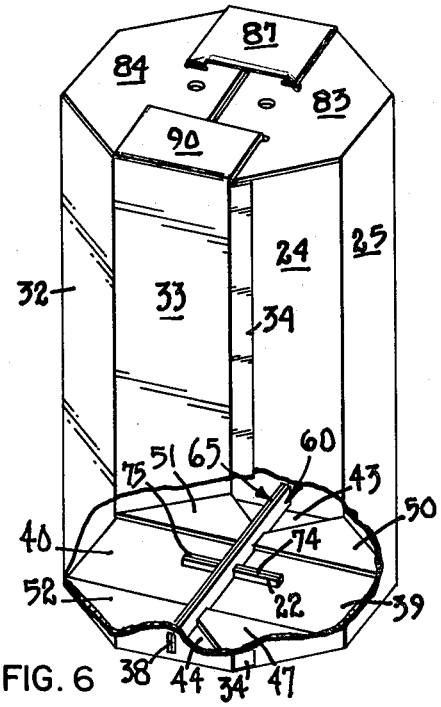
FIG. 6 is a view in perspective of the closed carton seen from below, portions being broken away.
Figure 2:
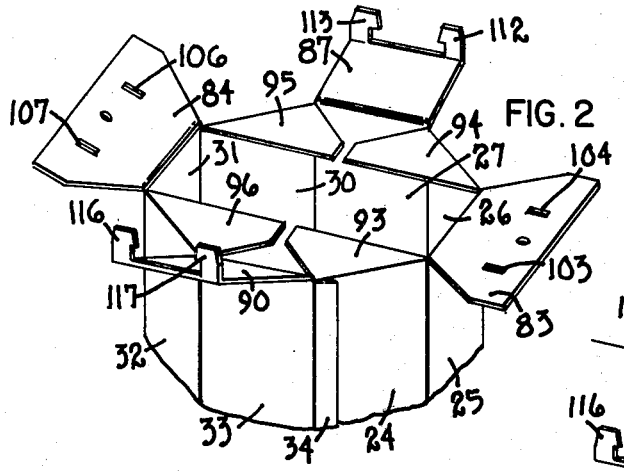
FIGS. 2 and 3 show steps for closing the bottom of the carton, to a larger scale, FIGS. 4 and 5 similarly show steps for enclosing the top of the carton.
Figure 3:
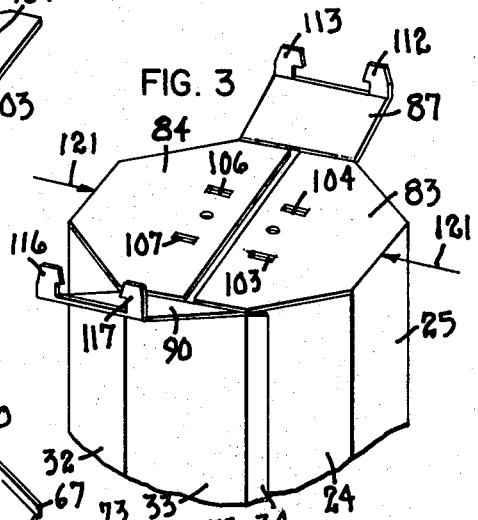

To form a carton according to this embodiment, the body is folded along fold lines 35 and flap 34 is secured to edge 36 of panel 24. The bottom closure is formed by folding lips 93, 94, 95, and 96 inward, as shown in FIG. 2; inner flaps 83 and 84 are then folded inward as shown in FIG. 3; and outer flap 87 is folded so that tabs 112 and 113 enter slots 104 and 106, and outer flap 90 is folded so that tabs 117 and 116 enter slots 103 and 107, flaps 83 and 84 being pressed together for that purpose as indicated by the arrows 121 in FIG. 3. The bottom closure is now as shown at the top of FIG. 6. When the carton is inverted and a bottom liner 122 of the proper dimensions is inserted and pushed downward, flaps 83 and 84 are urged apart as indicated by the arrows 123 in FIG. 8 (a bottom view) causing tabs 112, 113, 116, and 117 to engage in the slots in inner flaps 83 and 84 so as to oppose loosening of outer flaps 87 and 90, and liner 122 presses tabs 112, 113, 116, and 117 flat against the inner surfaces of flaps 84 and 83 as shown in the bottom portion of FIG. 7 (a view from above). The carton is now ready to receive product.

The present carton advantageously combines lock tabs 112, 113, 116, and 117 and lock slots 103, 104, 106 and 107 with finger openings 105 and 108 and bottom liner 122. The finger openings are advantageous in that they aid in disengaging the tabs and slots whenever it is desired to disassemble the carton. Finger openings in a bottom are not used in the prior art since openings in the bottom of a carton seriously reduce the utility of the carton. The use of bottom liner 122 in the present invention, however, allows for the use of finger openings 105 and 108, and consequently openings 105 and 108 may be cooperatively placed with respect to lock tabs 112, 113, 116, and 117 and slots 103, 104, 106 and 107.

Figure 7:
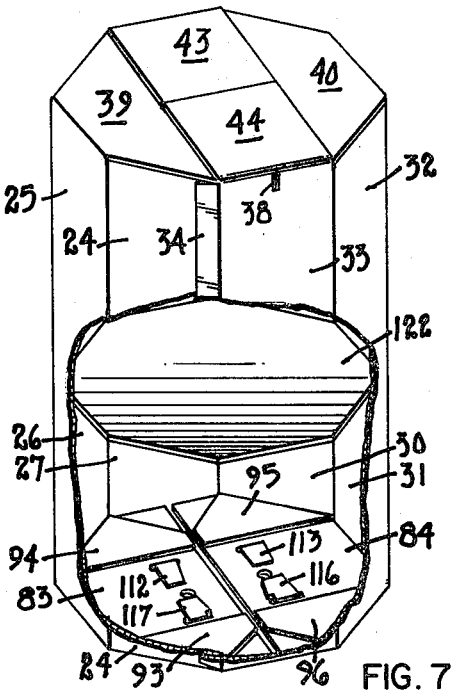
FIG. 7 is a similar view in perspective of the closed carton seen from above.
Figure 4:
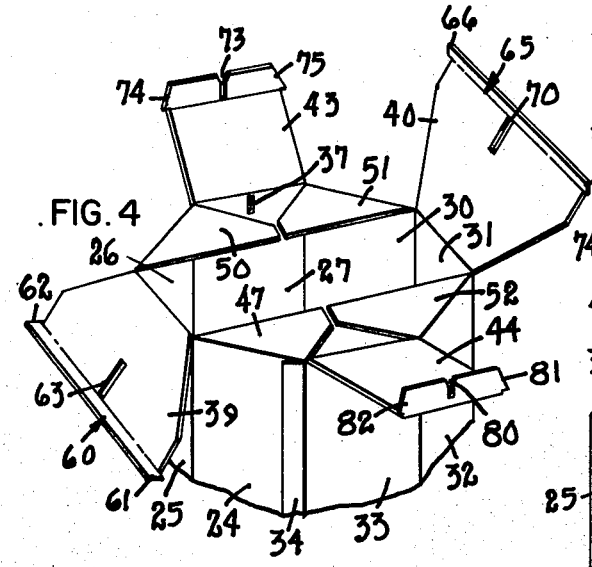
Figure 5:
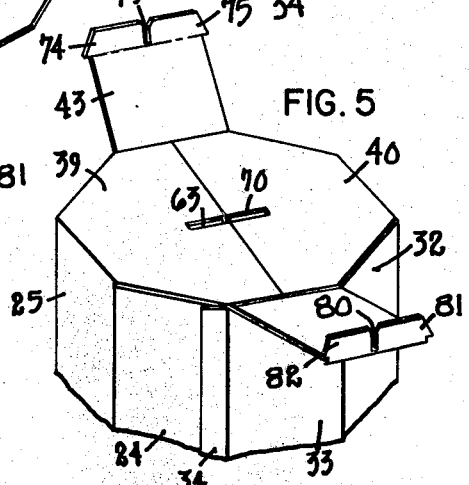
Figure 8:
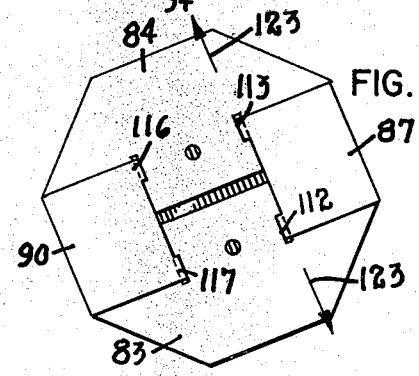
FIG. 8 is a bottom view of the closed carton after a bottom liner has been positioned.

After the carton is filled, it is closed as will now be described. Lips 47, 50, 51, and 52 are folded inward as shown in FIG. 4. Tab strips 60 and 65 are folded inward along fold lines 57 and 64, and then flaps 39 and 40 are folded inward along fold lines 41 and 42 until tabs 61 and 67 are received in slot 38 of body panel 33 and tabs 62 and 66 are received in slot 37 of body panel 27. Next flaps 43 and 44 are folded inward along fold lines 45 and 46, so that tabs 74 and 82 are received in slot 63 of flap 39, and tabs 75 and 81 are received in slot 70 of flap 40, note that slots 73 and 80 receive the centers of tab strips 60 and 65. The upper closure is now as shown at the top of FIG. 7, and if desired a sealing strip may be applied over the line of abutment of tabs 43 and 44.

Figure 9:
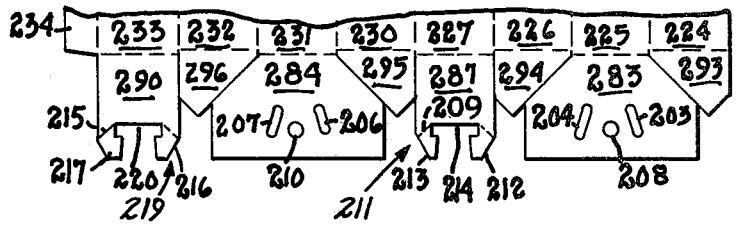
FIG. 9 is a fragmentary view like FIG. 1 showing a blank having a modified bottom closure construction.
Figure 10:
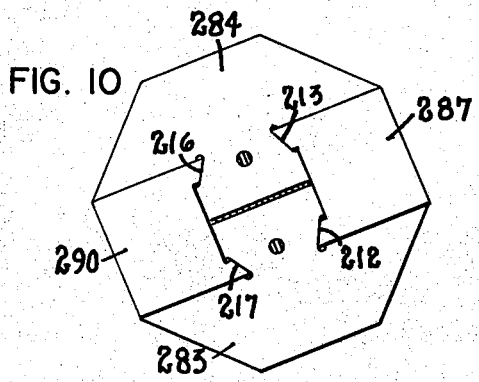
FIG. 10 is a bottom view of a closed carton having the modified bottom construction.

Attention is now directed to FIGS. 9 and 10, which show a modification of the bottom closure construction. Most parts are the same as in FIG. 1, and are given the same reference numerals in the 200 series. It is to be noted that slots 203, 204, 206, and 207 do not extend parallel to body fold lines 235, but converge toward the periphery of the carton. In the same way, fold lines 210 and 215 are not straight, but converge toward the carton periphery.

Figure 13:
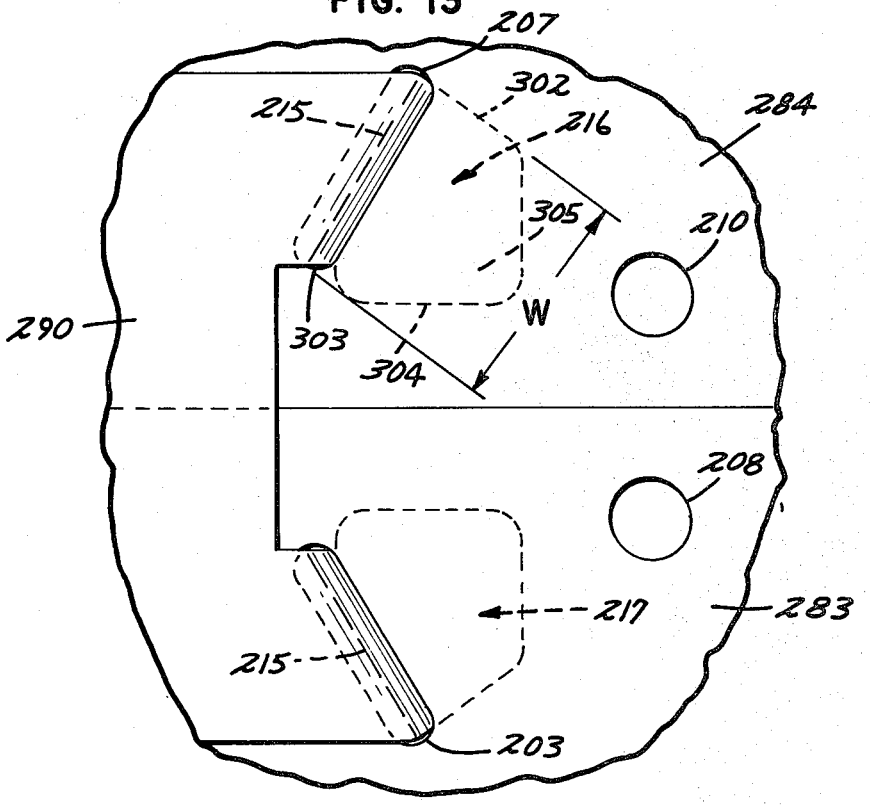
FIG. 13 is an enlarged view of a closure having angulated tabs and slots in accordance with the modified bottom construction showing inner flaps together as in FIG. 10.

As shown in FIG. 13, a particular lock tab such as 216 defines a length W along fold line 215. Lock tab 216 has a width parallel to the length W which does not exceed length W. In this fashion, tab 216 may be folded along line 215 to be perpendicular to outer flap 290 for easy insertion through slot 207, the length of slot 207 being only slightly longer than the length W. Lock tab 216 is angled in that the connecting portion 301 adjacent to outer flap 290 extends perpendicularly outwardly to approximately the midpoint of angled slot 207. The outer edge 302 of lock tab 216 then angles inwardly. The inner edge 303 abruptly forms a right angle to extend inwardly to the inwardmost edge 304 of lock tab 216. In this fashion, the inwardmost portion of lock tab 216 is inserted into slot 207 and allowed to relax from its perpendicular insertion position, then as shown in FIG. 13 lock tab 216 may not be retracted from slot 207 since locking portion 305 engages a solid edge of slot 207. Advantageously, however, a finger may be inserted in finger opening 210 to fold locking tab 216 downwardly thereby allowing extraction of locking tab 216 from slot 207 whenever desired.

Figure 11:
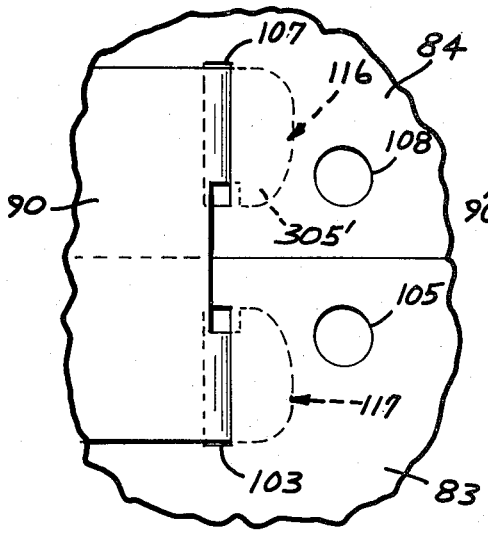
FIG. 11 is an enlarged view of a closure having straight lock tabs and slots as in FIG. 1.
Figure 12:
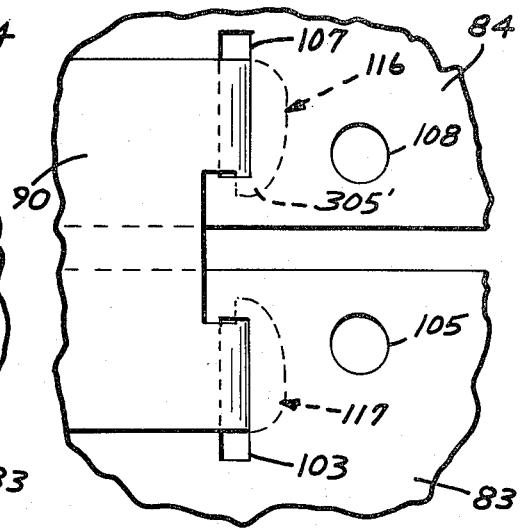
FIG. 12 is an enlarged view of the closure of FIG. 11 showing inner flaps separated as in FIG. 8.

Upon comparison of FIG. 13 with FIGS. 11 and 12, locking tab 216 is distinguished from locking tab 116. Slot 107 must be sufficiently long to allow insertion of the entire width of locking tab 116 including the locking portion 305'. In order to prevent undesirable slipping of lock tab 116 from slot 107, inner flaps 83 and 84 must be separated. In a carton having lock tabs such as 216 such separation is unnecessary.

From the foregoing it is evident that the invention comprises a carton having closures at its ends which are integral with the body of the carton. While the disclosure is specifically of cartons having opposite end closures of different constructions, it will be evident that identical closures can be used at both ends of the carton if this is desired.

Thus, numerous characteristics and advantages of the invention have been set forth in the foregoing description, together with details of the structure and function of the invention, with the novel features thereof being pointed out in the appending claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A carton having an integral self-locking end closure, comprising, in combination:

a carton body having pairs of opposite panels integral along longitudinal fold lines;

outer flaps integral along first transverse fold lines with the panels of a first pair and along second transverse fold lines with first tab strips having central slots and first outward lock tabs, the panels of said first pair having medial lock slots near said first fold line; and inner flaps integral along third transverse fold lines with the panels of a second pair and along fourth transverse fold lines with second tab strips having second outward lock tabs, said inner flaps having center slots terminating near said fourth transverse fold lines, so that when said inner flaps are folded in the same direction on said third and fourth transverse fold lines said second lock tabs are received in said lock slots of said first pair of panels to pass outward therethrough, and when said outer flaps are then folded in the same direction on said first and second transverse fold lines, said central slots of said first tab strips receive said second tab strips, and said first lock tabs are received in said center slots of said inner flaps to pass inwardly therethrough.

2. A carton having an integral self-locking closure, comprising:

a carton body having pairs of opposite panels integral along longitudinal fold lines;

outer flaps integral along first transverse fold lines with the panels of one pair and along second transverse fold lines with first tab strips having central recesses and inward lock tabs, said second transverse fold lines being first converging broken lines, each of said lock tabs defining a length along said first converging broken lines, each of said lock tabs having a width parallel to and not exceeding said length;

inner flaps integral along third transverse fold lines with the panels of a second pair, said inner flaps each having a pair of spaced lock slots, said lock slots being approximately centered on second converging broken lines parallel to said first converging broken lines, said lock slots being also approximately centered on and slightly longer than said lengths of said lock tabs;

whereby when said inner flaps are folded on said third transverse fold lines and said outer flaps are then folded on said first and second transverse fold lines, each of said lock tabs is received in one of said lock slots to pass inwardly therethrough, said lock tabs being inextractable from said lock slots except when said lock tabs are folded along said second transverse lines.

3. A carton having an integral self-locking closure, comprising, in combination:

a carton body having pairs of opposite panels integral along longitudinal fold lines;

outer flaps integral along first transverse fold lines with the panels of one pair and along second transverse fold lines with first tab strips having central recesses and inward lock tabs;

inner flaps integral along third transverse fold lines with the panels of a second pair, said inner flaps each having a pair of spaced lock slots, said inner flaps each having a finger opening therein; and a bottom liner insertable in the carton to overlie said lock tabs to hold said tabs flat against inner surfaces of said inner flaps;

whereby said bottom liner covers said finger openings, said finger openings enabling disengagement of said lock tabs from said lock slots without harming said lock tabs, thereby providing for disassembly of a used carton.

4. A carton having a body and first and second self-locking end closures integral therewith;

said body comprising pairs of opposite panels integral along longitudinal fold lines;

said first closure comprising:

first outer flaps integral along first transverse fold lines with the panels of a pair and along second transverse fold lines with first tab strips having central slots and first outward lock tabs, the panels of said one pair having medial lock slots near said first transverse fold lines; and first inner flaps integral along third transverse fold lines with the panels of another pair and along fourth transverse fold lines with second tab strips having second outward lock tabs, said first inner flaps having center slots terminating near said fourth transverse fold lines; and said second closure comprising:

second outer flaps integral along fifth transverse fold lines with the panels of a pair and along sixth transverse fold lines with third tab strips having central recesses and pairs of inward lock tabs, said fifth transverse fold lines being first converging broken lines, each of said lock tabs defining a length along said first converging broken lines, each of said lock tabs having a width parallel to and not exceeding said length;

second inner flaps integral along seventh transverse fold lines with the panels of another pair, said second inner flaps each having a pair of spaced lock slots, said lock slots being approximately centered on second converging broken lines parallel to said first converging broken lines, said lock slots being also approximately centered on and slightly longer than said lengths of said lock tabs, said second inner flaps each having a finger opening therein; and a bottom liner insertable in the carton to overlie said lock tabs to hold said tabs flat against inner surfaces of said second inner flaps.

* * * * *